US008128882B2

(12) United States Patent
Tomosue et al.

(10) Patent No.: US 8,128,882 B2
(45) Date of Patent: Mar. 6, 2012

(54) CATALYTIC CONVERTER, HOLDING MATERIAL FOR CATALYTIC CONVERTER AND PRODUCTION METHOD THEREOF

(75) Inventors: Nobuya Tomosue, Tokyo (JP); Kazutoshi Isomura, Tokyo (JP); Tadashi Sakane, Tokyo (JP)

(73) Assignee: Nichias Corporation, Tokyo (JP)

( * ) Notice: Subject to any disclaimer, the term of this patent is extended or adjusted under 35 U.S.C. 154(b) by 756 days.

(21) Appl. No.: 12/175,509

(22) Filed: Jul. 18, 2008

(65) Prior Publication Data

US 2009/0022633 A1 Jan. 22, 2009

(30) Foreign Application Priority Data

Jul. 20, 2007 (JP) ..... P. 2007-189192

(51) Int. Cl.
*B01D 50/00* (2006.01)

(52) U.S. Cl. ..... 422/179

(58) Field of Classification Search ..... 422/177, 422/179, 180
See application file for complete search history.

(56) References Cited

U.S. PATENT DOCUMENTS

| | | | |
|---|---|---|---|
| 5,556,689 A | 9/1996 | Kratel et al. | |
| 6,589,488 B1 | 7/2003 | Eyhorn | |
| 6,787,191 B2 | 9/2004 | Hanahata et al. | |
| 2004/0177609 A1 * | 9/2004 | Moore et al. | 60/323 |
| 2009/0060800 A1 | 3/2009 | Fernandes, Jr. | |

FOREIGN PATENT DOCUMENTS

| | | |
|---|---|---|
| JP | 61-72819 | 4/1986 |
| JP | 5-221741 | 8/1993 |
| JP | 6-327937 | 11/1994 |
| JP | 2002-502930 | 1/2002 |
| JP | 2002-70529 | 3/2002 |
| JP | 2002-509221 | 3/2002 |
| JP | 2002-137912 | 5/2002 |
| JP | 2003-515442 | 5/2003 |
| JP | 2004-517222 | 6/2004 |
| JP | 2006-299966 | 11/2006 |
| WO | WO 01/74957 A1 | 10/2001 |

OTHER PUBLICATIONS

Office Action (and English translation) mailed Mar. 1, 2011 in JP 2007-189192.
JP Office Action and English translation in JP 2007-189192 mailed Dec. 6, 2011.
Office Action in Application No. GB 0813118.7 dated Oct. 19, 2011.

* cited by examiner

*Primary Examiner* — Tom Duong
(74) *Attorney, Agent, or Firm* — Nixon & Vanderhye P.C.

(57) ABSTRACT

The present invention relates to a holding material for a catalytic converter including a catalyst carrier, a metal casing for receiving the catalyst carrier, and the holding material wound around the catalyst carrier and interposed in a gap between the catalyst carrier and the metal casing, the holding material including a low thermal conductivity layer, in which the low thermal conductivity layer includes: a molded material containing an inorganic powder; or a composite material of a porous substrate with an aerogel.

5 Claims, 6 Drawing Sheets

(A)

(B)

CATALYTIC CONVERTER, HOLDING MATERIAL FOR CATALYTIC CONVERTER AND PRODUCTION METHOD THEREOF

FIELD OF THE INVENTION

The present invention relates to a catalytic converter (also referred to as an exhaust gas purifying apparatus) for removing particulates, carbon monoxide, hydrocarbons, nitrogen oxides and the like contained in exhaust gas discharged from an internal combustion engine such as a gasoline engine or a diesel engine, a holding material for a catalytic converter for holding a catalyst carrier in a metal casing, and a production method thereof.

BACKGROUND OF THE INVENTION

It has recently become a problem that particulates contained in exhaust gas discharged from internal combustion engines of vehicles such as buses and trucks, construction machines and the like cause harm to the human body and the environment. Various catalyst converters which can collect the particulates in the exhaust gas to purify the exhaust gas have been proposed.

FIG. 10 is a cross-sectional view schematically showing an embodiment of a catalytic converter. In this catalytic converter 10, an introduction pipe 16 through which exhaust gas discharged from an internal combustion engine is introduced is connected to one end of a metal casing 11, and a discharge pipe 17 through which the exhaust gas which has passed through a catalyst carrier 12 is discharged outside is attached to the other end thereof. Further, the catalyst carrier 12 is provided inside the metal casing 11 with the intervention of a holding material 13 for a catalyst converter. Furthermore, an electric heater and a temperature sensor for burning particulates accumulated in the catalyst carrier, namely a honeycomb filter, to recover a filtering function (also referred to as regeneration treatment) may be provided on an exhaust gas introduction side (also referred to as a suction side) with respect to a catalyst carrier, and another pipe for feeding combustion air may be connected thereto, although not shown in the figure. According to such constitution, when the amount of the particulates accumulated in the catalyst carrier increases to result in an increase in pressure drop, the regeneration treatment can be conducted.

Further, the holding material 13 for a catalyst converter is a mat material obtained by forming inorganic fibers to a specified thickness, and the shape thereof is a planar shape, for example, shown in FIG. 11(A). A convex portion 42 is formed on one end of a tabular main body portion 41, and a concave portion 43 having a shape fittable with the shape of the convex portion 42 is formed on the other end. Then, as shown in FIG. 11(B), the main body portion 41 is wound around an outer peripheral surface of the catalyst carrier 12, and the convex portion 42 and the concave portion 43 are engaged with each other, thereby winding the holding material 13 for a catalyst converter around the catalyst carrier 12.

The holding material 13 for a catalyst converter has functions of stably holding the catalyst carrier 12 inside the metal casing 11, maintaining the catalyst carrier 12 at high temperature by heat insulation and keeping a catalytic function good. Accordingly, particularly in a cold region, there is concern that an increase in temperature of the catalyst carrier 12 is inhibited by the influence of outside air temperature, or that the time required for the above-mentioned regeneration treatment increases. Further, the temperature of an outer peripheral portion of the catalyst carrier 12 decreases in regeneration, and unburned particulates remain in this outer peripheral portion to increase a rise in pressure drop. As a result, there is concern that the time taken until the regeneration treatment is required decreases. Furthermore, the temperature difference between the internal temperature (about 600° C.) and the external temperature is large, so that when heat insulation performance of the holding material 13 is not sufficient, thermal stress is generated due to the temperature difference which occurs between a vicinity of a center portion of the catalyst carrier 12 and a vicinity of the outer peripheral portion thereof, resulting in easy occurrence of cracks in the catalyst carrier 12. As a result, there is also concern that durability is impaired.

In recent years, the exhaust gas temperature decreases in many cases, at the time of idling driving in a traffic jam or at the time of engine stop, because some recent automobiles have a function of stopping an engine (idling stop) at the time of stopping, giving consideration to the environment. It becomes therefore more difficult to maintain the catalyst carrier 12 at the treatment temperature even in a region where is not a cold region. Further, it is necessary to early elevate the temperature of the exhaust gas to the treatment temperature of the catalyst carrier 12.

From such a background, countermeasures of defining the thermal conductivity of the holding material 13 for a catalyst converter and the like have been taken (see JP-A-2002-70529 and JP-A-2006-299966).

SUMMARY OF THE INVENTION

In order to avoid disadvantages caused by a decrease in the exhaust gas temperature as described above, temperature keeping of the catalyst carrier 12 and a reduction in heatup time are anticipated to be required in the future, and further improvement in heat insulation performance of a holding material for a catalytic converter is inevitable. Therefore, an object of the invention is to provide a holding material for a catalytic converter more excellent in heat insulation performance and a high-performance catalytic converter having the above-mentioned holding material for a catalytic converter and having high catalytic efficiency.

In order to achieve the above-mentioned object, the invention provides a catalytic converter, a holding material for a catalytic converter and a production method thereof as described below:

(1) A holding material for a catalytic converter including a catalyst carrier, a metal casing for receiving the catalyst carrier, and the holding material wound around the catalyst carrier and interposed in a gap between the catalyst carrier and the metal casing, the holding material including a low thermal conductivity layer, in which the low thermal conductivity layer includes: a molded material containing an inorganic powder; or a composite material of a porous substrate with an aerogel.

(2) The holding material according to (1), in which the low thermal conductivity layer has a thermal conductivity at 300° C. of 0.04 W/m·K or less.

(3) The holding material according to (1), further including a mat layer including inorganic fibers and laminated on the low thermal conductivity layer.

(4) The holding material according to (1), further including a protective layer.

(5) A method for producing a holding material for a catalytic converter including a catalyst carrier, a metal casing for receiving the catalyst carrier, and the holding material wound around the catalyst carrier and interposed in a gap between the catalyst carrier and the metal casing, which method includes:

impregnating a whole porous substrate with an aerogel precursor; and conducting supercritical drying to produce a low thermal conductivity layer.

(6) The method for producing the holding material according to (5), further including joining the low thermal conductivity layer to a mat layer.

(7) A method for producing a holding material for a catalytic converter including a catalyst carrier, a metal casing for receiving the catalyst carrier, and the holding material wound around the catalyst carrier and interposed in a gap between the catalyst carrier and the metal casing, which method includes:

impregnating a surface of the mat material including a porous substrate with an aerogel precursor; and conducting supercritical drying to produce a low thermal conductivity layer.

(8) A catalytic converter including a catalyst carrier, a metal casing for receiving the catalyst carrier, and a holding material wound around the catalyst carrier and interposed in a gap between the catalyst carrier and the metal casing, in which the holding material is a holding material according to (1).

The holding material for a catalytic converter of the invention is greatly enhanced in heat insulation performance by existence of the low thermal conductivity layer, and can be more improved in exhaust gas purifying performance due to the catalytic converter.

DESCRIPTION OF REFERENCE NUMERALS AND SIGNS

10 Catalytic Converter
11 Metal Casing
12 Catalyst Carrier
13 Holding Material for Catalytic Converter
41 Main Body Portion
42 Convex Portion
43 Concave Portion

DETAILED DESCRIPTION OF THE INVENTION

The invention will be described in detail below with reference to the drawings.

Figure 1:
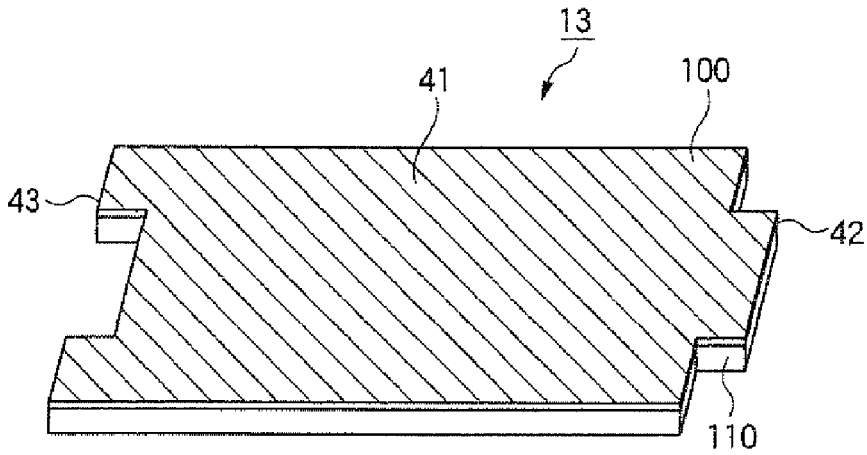
FIG. 1 is a schematic view showing one embodiment of a holding material for a catalytic converter of the invention.
Figure 11:
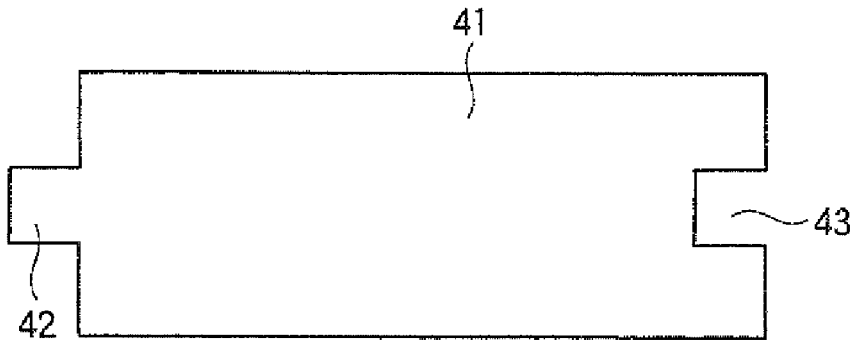
FIG. 11(A) is a top view showing one embodiment of a conventional holding material for a catalytic converter.
FIG. 11(B) is a schematic view showing a state that a holding material for a catalytic converter is wound around a catalyst carrier.
Figure 11:
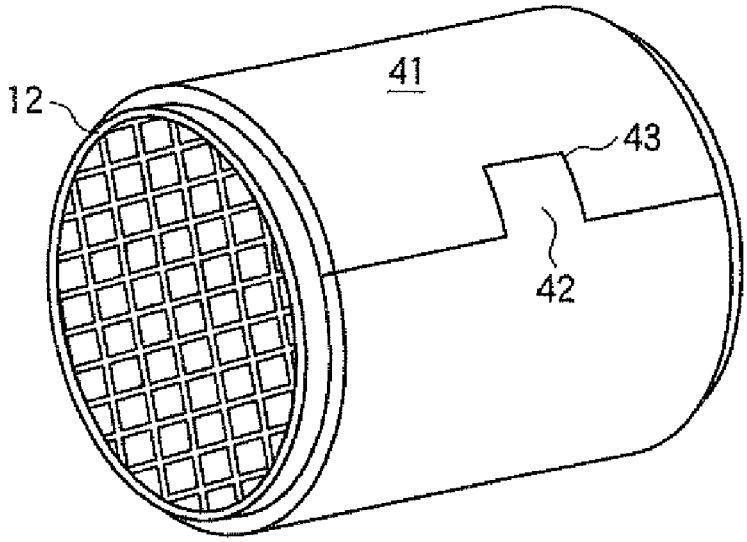

The holding material for a catalytic converter of the invention is constituted by laminating a low thermal conductivity layer 100 and a mat layer 110 obtained by forming inorganic fibers, as shown in FIG. 1. Further, although not shown in the drawing, the low thermal conductivity layer 100 and the mat layer 110 may be alternately laminated in multilayer form. There is no restriction on the overall shape. For example, similarly to the holding material shown in FIG. 11(A), it can be a shape in which a convex portion 42 is formed on one end of a tabular main body portion 41, and a concave portion 43 having a shape fittable with the shape of the convex portion 42 is formed on the other end. The shape of the convex portion 42 and the concave portion 43 may be triangular or semicircular, as well as the rectangular shape shown in the drawing. Further, the number of the convex portion 42 and the concave portion 43 is not limited to one, and may be two or more.

In order to obtain sufficient heat insulation performances, the low thermal conductivity layer 100 has preferably a thermal conductivity at 300° C. of 0.04 W/m·K or less, and more preferably a thermal conductivity at 600° C. of 0.05 W/m·K or less. The thermal conductivity as referred to herein is measured in accordance with JIS A1412-1.

There is no particular restriction on the low thermal conductivity layer 100, as long as it satisfies the above-mentioned thermal conductivity. However, for example, a molded material containing an inorganic powder or a composite material of a porous substrate with an aerogel, as described later, can be suitably utilized.

The inorganic powder-containing molded materials include a sheet obtained by compression molding the inorganic powder by a dry system as it is, a sheet obtained by kneading the inorganic powder with the porous substrate and a sheet obtained by solidifying the inorganic powder with a binder. The inorganic powder is preferably a fine powder having a particle size of 1 to 70 nm in terms of heat insulation performance and in that compression molding is possible without using any binder. Examples of the inorganic powder include a fine powder comprising a metallic oxide such as silica, alumina, titanium oxide and the like. Of these, fumed silica (dry silica) prepared by gas-phase process is particularly preferred. Fumed silica is an extremely minute fine powder, so that it associates by intermolecular force or the like to form secondary particles having a diameter of several tens of nanometers to several micrometers, thereby forming many spaces having a ring inner diameter of 0.1 μm or less. Such spaces are smaller than the mean free path of air acting as a heat transmitting medium, so that heat transmission can be significantly decreased through fumed silica. Accordingly, heat insulation performance can be dramatically enhanced. Further, fumed silica may be hydrophobic fumed silica which is obtained by the reaction between a silanol group thereof and an organic group such as methyl group by using a coupling agent. A compression molded article of the hydrophobic fumed silica hardly undergoes a deterioration in heat insulating property due to the moisture absorption, in comparison with a compression molded material of the hydrophilic fumed silica.

Further, the inorganic powder may comprises an inorganic powder having a specific refractive index to a light having a wavelength of 1 μm or more of 1.25 or more and a particle size of 1 to 50 μm, such as silicon carbide, zirconia or titania. Such inorganic particles have a function of reflecting radiant heat, and combined use thereof can prevent an increase in thermal conductivity caused by radiant heat.

The sheet obtained by compression molding of the inorganic powder by a dry system can be prepared by filling the above-mentioned inorganic powder in a molding die and pressing. As for molding conditions at that time, a press pressure of 0.5 to 1.5 MPa is suitable.

The sheet obtained by kneading the inorganic powder with the porous substrate can be prepared by scattering the inorganic powder on an whole surface of the sheet-like porous substrate, pressing the inorganic powder onto the porous substrate by using a paddle or the like to force the inorganic powder into spaces of the porous substrate, followed by compressing. Thereby, the sheet in which the porous substrate and the inorganic powder are compounded without using any binder can be obtained.

Here, there is no particular restriction on the porous substrate, as long as it has spaces into which the inorganic powder enters. Specifically, examples of the porous substrates include inorganic porous substrates such as glass cloth, inorganic paper (nonwoven fabric) and a mat material of an inorganic fiber blanket described later or the like, and organic porous substrates such as aramid fiber felt and nonwoven fabric made of polyethylene terephthalate (PET), a polyester or the like. When heat resistance is required, it is preferred that the inorganic porous substrates are used.

The sheet obtained by solidifying the inorganic powder with a binder can be prepared by forming a kneaded product or a slurry of the inorganic powder and the binder into a sheet form. Examples of the binders include inorganic binders such as glass frit, colloidal silica, alumina sol, silica sol, silicate soda, titania sol, lithium silicate and water glass, and organic binders such as an acrylic resin and starch. When heat resistance is required, it is preferred to use the inorganic binders.

The sheet may be used either nonintegrated with the mat layer 110 separately prepared, or integrated therewith by joining. The joining can be effected by adhesion, needling, sewing or the like. The sheet thickness is suitably from 5 to 50%, and may be from 10 to 40% or from 15 to 30%, relative to the total thickness of the mat layer 110, taking into consideration improvement in heat insulation performance, winding properties around the catalyst carrier and the like.

Additionally, a surface or whole of these sheets may be subjected to the resin coating treatment with a resin such as silicone or polyvinyl alcohol. By this treatment, it is possible to prevent the inorganic powder from dropping off, particularly, at an end face on a suction side.

When the sheet is used nonintegrated with the mat layer 110, the convex portion 42 and the concave portion 43 are formed in the mat layer 110. Further, the sheet may be wound in multilayer form. Methods for fixing the sheet include fixing engaged portions of sheet ends with a tape, binding with a string-like body, and the like. However, it may be merely wound. The string-like body may be a thermally degradable material, because after the catalyst carrier has been located in the metal casing, the holding material for a catalytic converter is not separated, even when the string-like body is degraded by heat.

Further, a coating obtained by binding the inorganic powder with the binder can also be used as the low thermal conductivity layer 100. The low thermal conductivity layer 100 can be prepared by applying a coating solution containing the inorganic powder and the binder to the mat layer 110, followed by drying. The applied amount thereof is suitably from 0.1 to 10.0 g/m$^2$, although it is appropriately set, taking into consideration improvement in heat insulation performance, winding properties around the catalyst carrier and the like.

Further, as the low thermal conductivity layer 100, it can also be used the composite material of the porous substrate with the aerogel. The aerogel is produced by removing a movable solvent phase between lattices from pores of a gel structure having continuous air bubbles supported by a polymer material, under higher temperature and pressure than the critical points of this solvent. Accordingly, the aerogel is low in density, and has a cluster structure in which spherical fine particles having an average size of 2 to 7 nm are fused together. Furthermore, the aerogel has a continuous air bubble structure having an average pore size of 2 to 7 nm, so that it has a large surface area. In the aerogel, the air cannot act as a convective flow going over a lattice-like structure, so that it efficiently inhibits heat transmission due to the convective flow. For this reason, it exhibits astounding heat insulation properties. The average size of pores and density can be adjusted at the time of production.

Examples of the above-mentioned aerogels include inorganic aerogels and organic aerogels. The inorganic aerogels are one having a metal alkoxide group, and include materials such as silica, a carbide and alumina. Examples of organic aerogels include polymer aerogels such as a carbon aerogel and a polyimide. Of these, the silica aerogel is preferred, because it has many production examples and is easily available. A production method of the aerogel is described, for example, in JP-T-2004-517222. The structure of the composite material of the porous substrate with the aerogel has a composite structure of a structure of the porous substrate with the lattice-like structure of the aerogel. The bulk density of the composite material is from 0.02 to 0.5 g/cm$^3$, and preferably from 0.1 to 0.3 g/m$^3$.

This composite material of the porous material with the aerogel is obtained by impregnating the porous material with the aerogel, followed by drying in a supercritical region. Specifically, for example, when the aerogel is the silica aerogel, a silane compound such as tetraethoxysilane, tetramethoxysilane or tetra-n-propoxysilane is hydrolyzed, and then, a silica precursor stabilized at a low pH as a polysilicate ester, for example, a polymer such as polydiethoxysiloxane, is prepared. This silica precursor and an alcohol such as ethanol are mixed to obtain a silica precursor solution. The compounding ratio of the silica precursor to the alcohol at this time is suitably from 0.1-5.0 to 1.0. Then, the porous substrate is impregnated with this silica precursor solution, and an acid such as hydrochloric acid, sulfuric acid or hydrofluoric acid is added thereto to perform gelation, followed by aging of the gel. Then, when supercritical drying treatment is conducted to remove the alcohol from the gel, the silica aerogel having the porous substrate as a reinforcing substrate, namely, the aerogel porous substrate, is formed. The supercritical drying treatment can be conducted by first replacing the alcohol with liquid acetone, and then placing carbon dioxide on a critical point. Use of liquid acetone makes it possible to realize good gradient elution. Finally, all liquids in the gel are replaced with gas without impairing a structure of the gel.

Here, the whole porous substrate is impregnated with the aerogel precursor, and thereafter conducting supercritical drying to prepare the low thermal conductivity layer 100, which may be used either after joined to the mat layer 110 separately prepared, or separately as it is. Further, using a mat material described later as the porous substrate, a surface thereof is impregnated with the aerogel precursor to form a laminated body having an aerogel precursor-impregnated layer impregnated with the aerogel precursor and a porous substrate layer not impregnated with the aerogel precursor, and the laminated body is dried in a supercritical region, thereby also being able to form the holding material 13 for a catalytic converter having the mat layer and the composite material (low thermal conductivity layer) of the porous substrate and the 15 aerogel. There is no particular restriction on the thickness of the low thermal conductivity layer 100, as long as the desired heat insulation performance is obtained. However, it is preferably from 3 to 50% relative to the total thickness of the mat layer 110. In the former case, the thickness of the porous substrate used is adjusted, and in the latter case, the amount impregnated is adjusted.

Further, the aerogel may be subjected to a hydrophobizing treatment. This treatment avoids a loss of the aerogel characteristics due to the moisture absorption with time. Therefore, it is possible to maintain the high heat insulating property (low thermal conductivity) over a long period. Examples of the preparation process of the hydrophobized aerogel include: a method where the supercritical drying treatment is conducted after the hydrophobizing treatment of the aerogel precursor in a liquid solvent; and a method where a hydrophobizing agent is added to the aerogel precursor during the supercritical drying to conduct the hydrophobizing treatment in the supercritical state.

On the other hand, there is no restriction on the mat layer, and one used in a conventional holding material for a catalytic converter can be used. For example, it can be appropriately selected from mat materials such as a compressed mat obtained by forming inorganic fibers and an organic binder in a wet system, and then drying under a compressed state; a mat including a blanket obtained by needling collected inorganic fibers; and an expanded mat obtained by forming inorganic fibers and an expanding material such as vermiculite in a wet system. These mat materials as the mat layer 110 can be used without any problem, as long as the thermal conductivity thereof is 0.2 W/m·K or less at 800° C. However, the thermal conductivity is preferably 0.1 W/m·K or less at 800° C.

As the inorganic fibers, it can be used various inorganic fibers which have hitherto been used in holding materials. For example, alumina fiber, mullite fiber and other ceramic fibers can be appropriately used. More specifically, as the alumina fiber, for example, one containing 90% or more by weight of $Al_2O_3$ (the remainder is $SiO_2$) and having low crystallinity in terms of X-ray crystallography is preferred. Further, the fiber diameter thereof is preferably from 3 to 15 μm, or 3 to 7 μm, and the wet volume thereof is preferably 400 cc/5 g or more. As the mullite fiber, for example, one having a mullite composition in which the weight ratio of $Al_2O_3/SiO_2$ is about 72/28 to 80/20 and X-ray crystallographically low in crystallinity is preferred. Further, the fiber diameter thereof is preferably from 3 to 15 μm, or 3 to 7 μm, and the wet volume thereof is preferably 400 cc/5 g. Examples of the other ceramic fibers include silica alumina fiber and silica fiber, and all of them may be ones which have hitherto been used in holding materials. Further, glass fiber, rock wool or biodegradable fiber may be incorporated therein.

The above-mentioned wet volume is calculated by the following method having the following steps:

(1) 5 grams of a dried fiber material is weighed by weigher with accuracy of two or more decimal places;

(2) The weighed fiber material is placed in a 500 g glass beaker;

(3) About 400 cc of distilled water having a temperature of 20 to 25° C. is poured into the glass beaker prepared in the step (2), and stirring is carefully performed by using a stirrer so as not to cut the fiber material, thereby dispersing the fiber material. For this dispersion, an ultrasonic cleaner may be used;

(4) The content of the glass beaker prepared in the step (3) is transferred into a 1,000 ml graduated measuring cylinder, and distilled water is added thereto up to the scale of 1,000 cc;

(5) Stirring of the graduated measuring cylinder prepared in the step (4) is performed by turning the cylinder upside down while blocking an opening of the graduated measuring cylinder with the palm of a hand carefully to prevent water from leaking out. This procedure is repeated 10 times in total;

(6) the sedimentation volume of fiber is measured by visual observation after placing the graduated measuring cylinder quietly under room temperature for 30 minutes after the stop of the stirring; and (7) The above-mentioned operation is performed for 3 samples, and an average value thereof is taken as a measured value.

Further, there is also no restriction on the bulk density of the mat layer 110. However, it is preferably from 0.13 to 0.7 g/cm$^3$ in a state wound around the catalyst carrier. When the bulk density is less than 0.13 g/cm$^3$, the mat layer is generally excellent in heat insulation performance. However, thermal conduction at high temperature is strongly influenced by radiant heat. As a result, the thermal conductivity increases, resulting in difficulty of satisfying the above-mentioned thermal conductivity, and there is concern of lacking in holding force for holding the catalyst carrier. On the other hand, when the balk density exceeds 0.7 g/cm$^3$, it does not happen that the thermal conductivity increases by the influence of radiant heat due to high temperature. However, conversely, solid conduction increases caused by too high bulk density, resulting in an increase in thermal conductivity. Accordingly, it becomes difficult to satisfy the above-mentioned thermal conductivity, and there is concern that it becomes difficult to insert the catalyst carrier with the holding material wound around the catalyst carrier into the metal casing.

The low thermal conductivity layer 100 may be provided so as to cover a whole planar surface of the mat layer 110, as shown in FIG. 1. However, since the low thermal conductivity layer 100 contains the inorganic powder, the inorganic powder is likely to drop off at the time of transportation or an operation for winding the low thermal conductivity layer around the catalyst carrier to contaminate the outside. It is therefore preferred that the area of the low thermal conductivity layer 100 is decreased within the range not affecting heat insulation performance.

Figure 2:
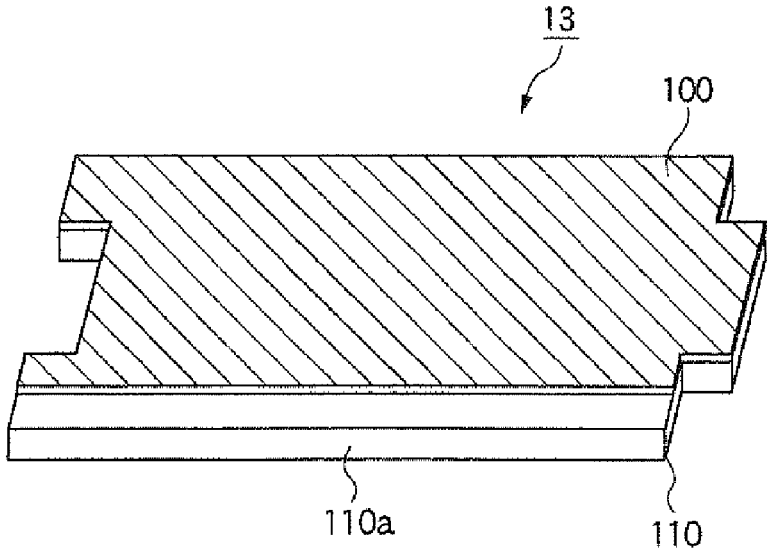
FIG. 2 is a schematic view showing another embodiment of a holding material for a catalytic converter of the invention.

In particular, as shown in FIG. 2, the low thermal conductivity layer 100 is provided backing away from an end face 110*a* on a suction side (the under side in the example shown in FIG. 2) of the catalytic converter of the mat layer 110, thereby being able to prevent the inorganic powder from dropping off due to suction.

Figure 3:
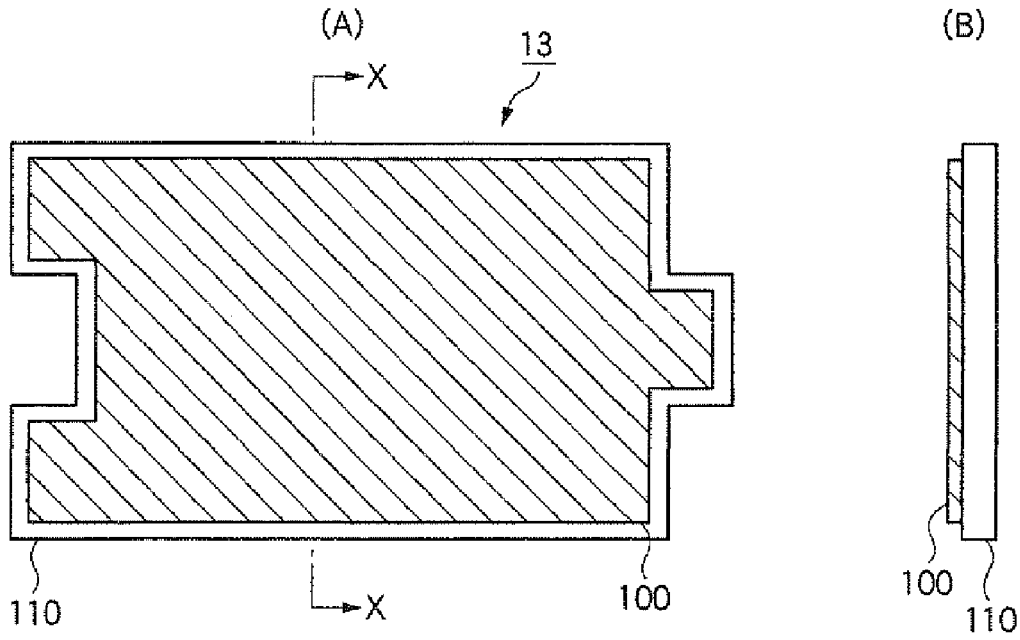
FIGS. 3(A) and (B) are schematic views showing still another embodiment of a holding material for a catalytic converter of the invention.

Further, as shown by a top view (A) and a cross-sectional view (B) taken along the line X-X in FIG. 3, the low thermal conductivity layer 100 may be provided leaving the whole circumference of the mat layer 110 uncovered.

Figure 4:
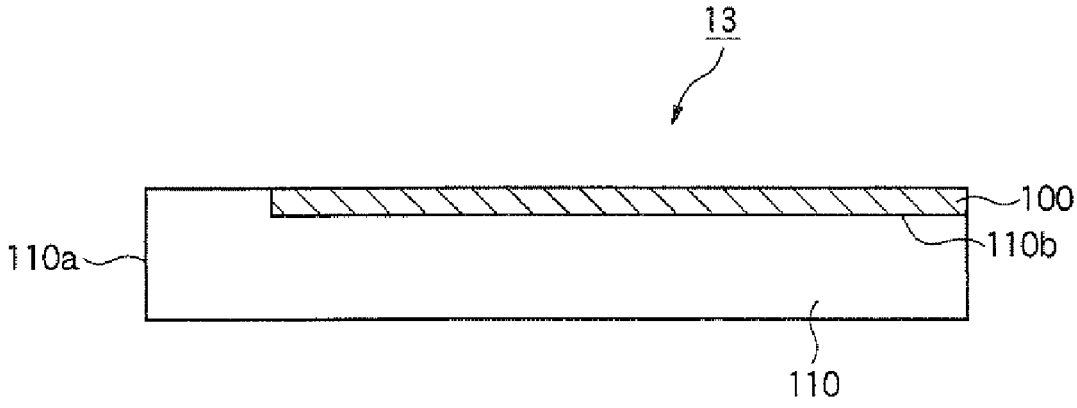
FIG. 4 is a schematic view showing yet still another embodiment of a holding material for a catalytic converter of the invention.

Furthermore, as shown in FIG. 4, the low thermal conductivity layer 100 can also be provided so as to be embedded in a concave portion 110*b* formed starting at a position apart from the end face 110*a* on the suction side of the mat layer 110.

Figure 5:
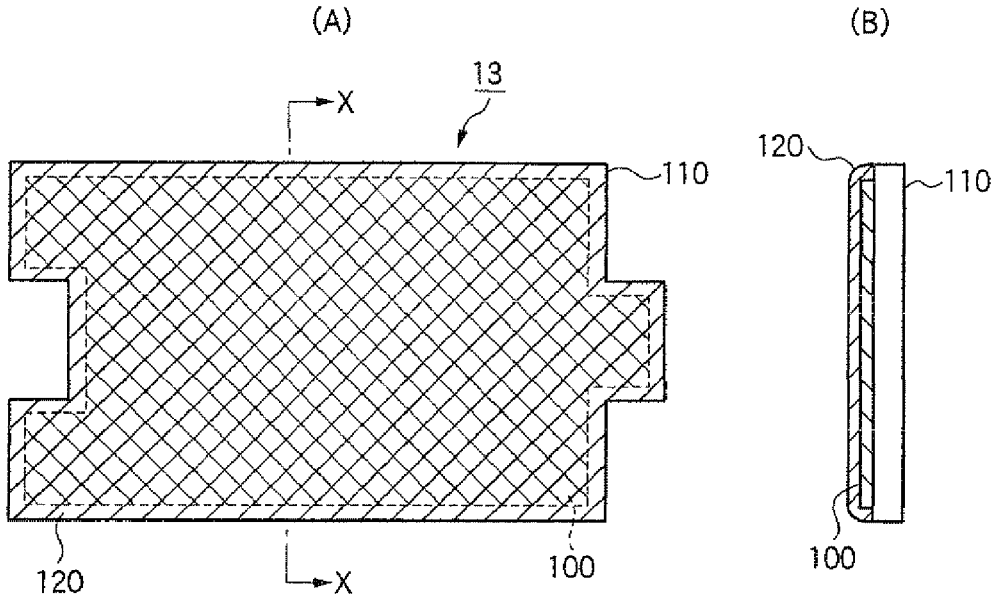
FIGS. 5(A) and (B) are schematic views showing a further embodiment of a holding material for a catalytic converter of the invention.
Figure 6:
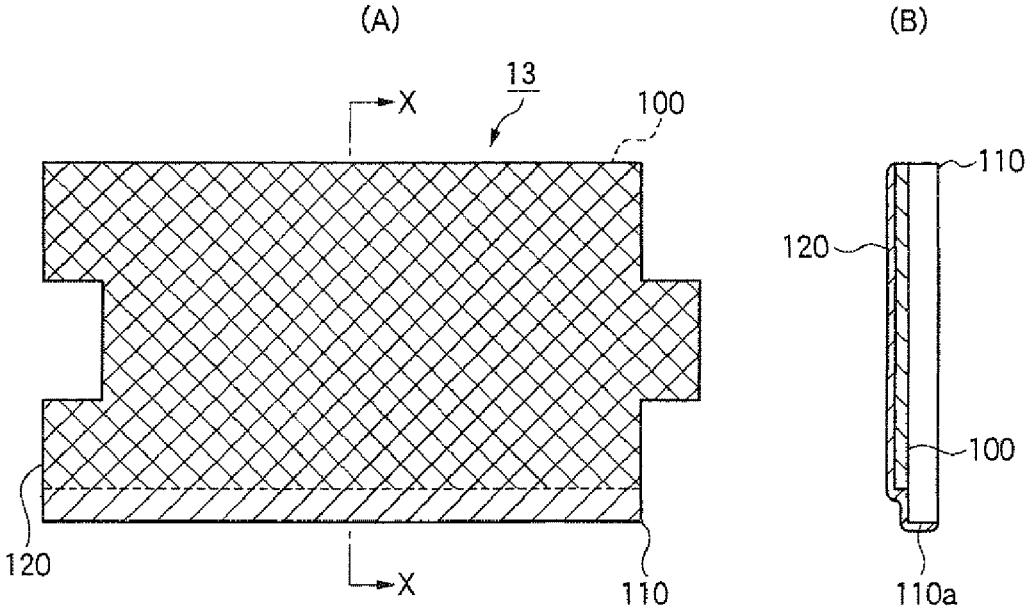
FIGS. 6(A) and (B) are schematic views showing a still further embodiment of a holding material for a catalytic converter of the invention.
Figure 7:
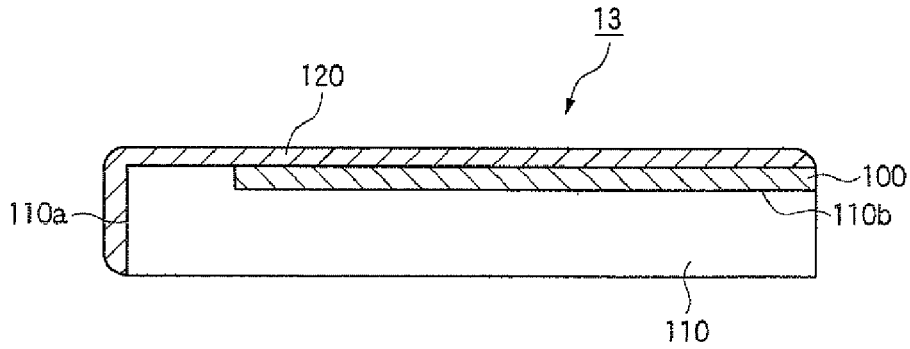
FIG. 7 is a schematic view showing a yet still further embodiment of a holding material for a catalytic converter of the invention.

In addition, in order to make surer that the inorganic powder is prevented from dropping off, it is preferred that at least the low thermal conductivity layer 100 is covered with a protective layer. FIG. 6((A) is a top view, and (B) is a cross-sectional view taken along the line X-X of (A)) shows the case where a protective layer 120 is formed on a whole surface of the holding material for a catalytic converter shown in FIG. 2 on which the low thermal conductivity layer 100 is provided, and further on the end face 110*a* on the suction side of the mat layer 110. Further, FIG. 5((A) is a top view, and (B) is a cross-sectional view taken along the line X-X of (A)) shows the case where a protective layer 120 is formed on a whole surface of the holding material for a catalytic converter shown in FIG. 3 on which the low thermal conductivity layer 100 is provided. Furthermore, FIG. 7 shows the case where a protective layer 120 is formed on a whole surface of the holding material for a catalytic converter shown in FIG. 4 on which the low thermal conductivity layer 100 is provided, and further on the end face 110*a* on the suction side of the mat layer 110.

As the protective layer 120, a synthetic resin film, a nonwoven fabric, a resin coating or the like is preferably used. Further, the protective layer not only prevents the inorganic powder from dropping off from the low thermal conductivity layer, but also can avoid the occurrence of defects such as cracks and fractures on an outer peripheral surface of the holding material even when the outer peripheral surface is stretched, because the difference between the outer and inner peripheries occurs in the holding material when the holding material is wound around the catalyst carrier, by disposing the protective layer as an outermost layer (metal casing side). Further, when pressed into the metal casing as a canning system (hereinafter also referred to as a press fitting system), the friction coefficient of the outer peripheral surface which contacts with the casing can be decreased, which makes it possible to improve workability of canning. In order to obtain such an effect, the friction coefficient of the protective layer is preferably from 0.1 to 0.4.

Figure 8:
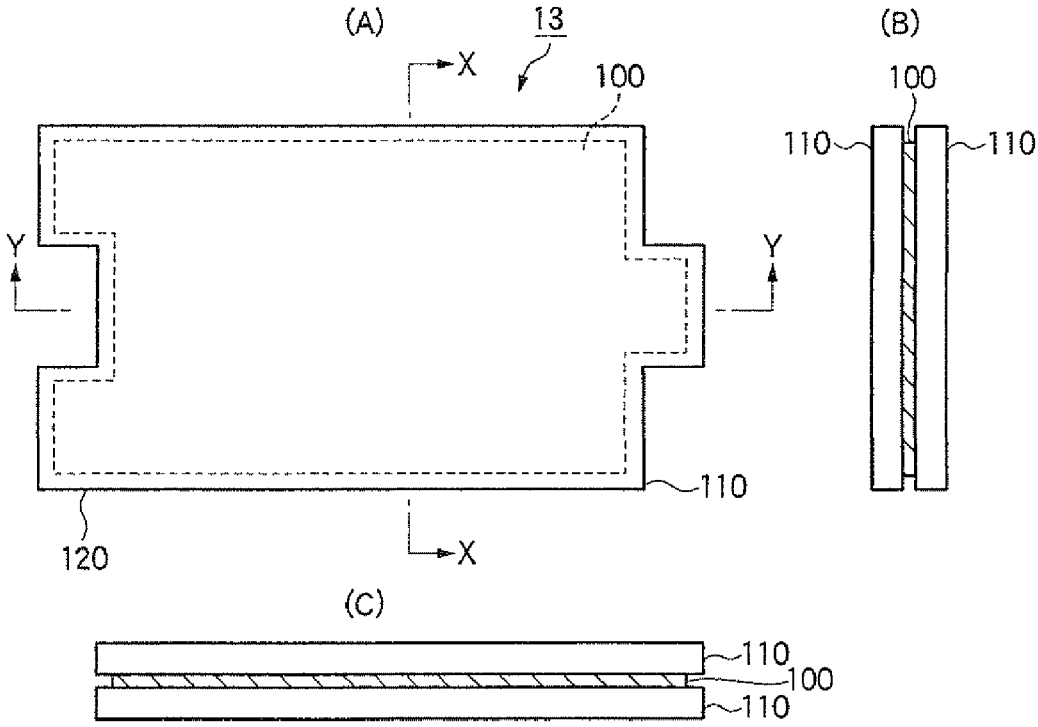
FIGS. 8(A), (B) and (C) are schematic views showing another embodiment of a holding material for a catalytic converter of the invention.
Figure 9:
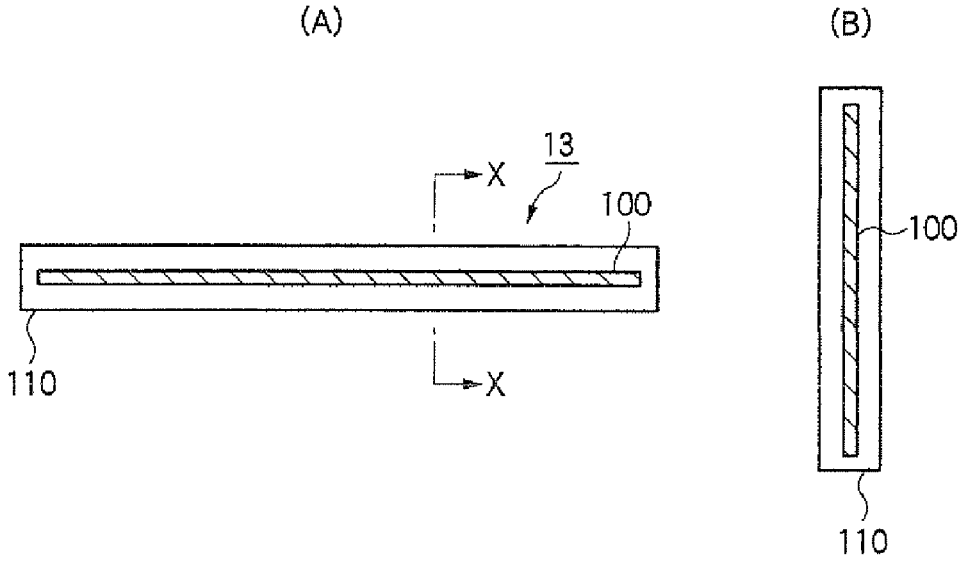
FIGS. 9(A) and (B) are schematic views showing still another embodiment of a holding material for a catalytic converter of the invention.

In order to prevent the inorganic powder from dropping off from the low thermal conductivity layer 100 and further from the end face 110*a* on the suction side, it is also possible to take a constitution of holding the low thermal conductivity layer 100 between the mat layers 110, as shown in FIG. 8((A) is a top view, (B) is a cross-sectional view taken along the line X-X of (A), and (C) is a cross-sectional view taken along the line Y-Y of (A)). In that case, as shown in the drawing, the area of the low thermal conductivity layer 100 is made smaller than that of the mat layers 110, thereby being able to more effectively prevent the inorganic powder from dropping off. Further, as shown in FIG. 9((A) is a top view, and (B) is a cross-sectional view taken along the line X-X of (A)), the low thermal conductivity layer 100 may be surrounded by the mat layer 110.

In preparing the holding material for a catalytic converter, the holding material may be prepared sheet by sheet by forming the mat layer 110 to a predetermined shape as shown in the drawing, and then, laminating thereon the low thermal conductivity layer 100 similarly formed to a predetermined shape. However, the holding material can be continuously prepared by laminating a long low thermal conductivity material to be formed into the low thermal conductivity layer 100 on a long inorganic fiber blanket to be formed into the mat layer 110, and then, stamping out the holding material into a predetermined shape.

In the holding material for a catalytic converter of the invention, in the same manner as in a conventional manner, for example, as shown in FIG. 1, the main body portion 41 is wound around the catalyst carrier 12, and the convex portion 42 and the concave portion 43 on both ends are engaged with each other, thereby winding the holding material 13 for a catalyst converter around the catalyst carrier 12. The engagement of the convex portion 42 with the concave portion 43 causes no occurrence of deviation at the end portion, leading to excellent dimensional stability.

In the holding material for a catalytic converter having the bilayer structure of the low thermal conductivity layer 100 and the mat layer 110 as shown in FIGS. 1 to 4, when the catalyst carrier 12 is used at a relatively low temperature up to about 500° C., the low thermal conductivity layer 100 may be arranged on the catalyst carrier side in winding it around the catalyst carrier 12. However, when the temperature of the catalyst carrier 12 exceeds 500° C., the low thermal conductivity layer 100 becomes liable to thermally deteriorate, so that the mat layer 110 is required to be arranged on the catalyst carrier side.

Further, when the low thermal conductivity layer 100 and the mat layer 110 are separately disposed, the low thermal conductivity layer 100 is wound around the catalyst carrier 12, and an engaged portion is fixed with a tape or the like. Then, the mat layer 110 is wound thereon. Alternatively, after the mat layer 110 has been wound around the catalyst carrier 12, the low thermal conductivity layer 100 is wound thereon, and an engaged portion is fixed with a tape or the like according to the necessity.

As described above, when the catalyst carrier 12 is used at a relatively low temperature up to about 500° C., contact of the low thermal conductivity layer 100 with the catalyst carrier 12 poses no particular problem. It is therefore most effective in heat insulation performance to constitute the holding material for a catalytic converter by only the low thermal conductivity layer 100. Namely, the low thermal conductivity layer 100 is formed to an usual holding material thickness, and can be used in the holding material for a catalyst carrier. In particular, the composite material of the porous substrate with the aerogel provides holding force of the catalyst carrier 12 due to elasticity of the porous substrate, and can be wound around the catalyst carrier. The invention also includes such a holding material for a catalyst carrier comprising only the low thermal conductivity layer 100.

Figure 10:
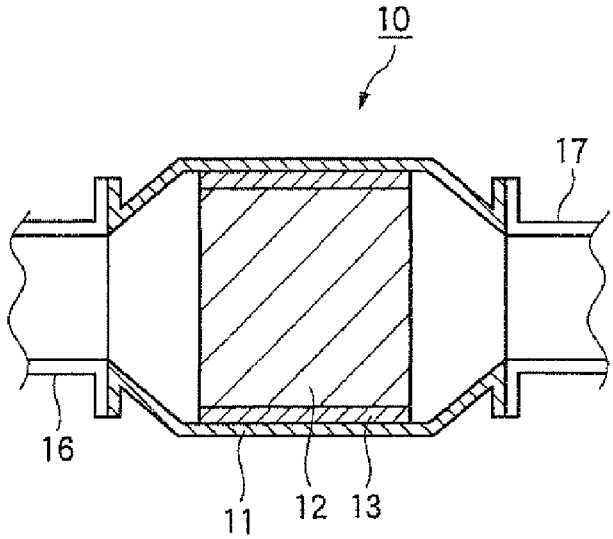
FIG. 10 is a cross-sectional view showing one embodiment of a catalytic converter.

Then, as shown in FIG. 10, the catalyst carrier 12 is accommodated in the metal casing 11 with the holding material 13 for a catalytic converter wound thereon, thereby preparing the catalytic converter 10. In this case, it is preferred that the variation in thickness of the holding material for a catalytic converter is small so as to uniformly apply holding force to a whole outer peripheral surface of the catalyst carrier 12 and so as to uniformly close a gap to the metal casing 11. The variation in thickness is desirably held down to 15% or less.

The size of the metal casing 11 is appropriately adjusted so that the catalyst carrier 12 can be mounted therein. Then, as shown in FIG. 10, an inlet pipe for allowing exhaust gas to flow in is connected to one end face of the metal casing 11, and an outlet pipe for discharging the exhaust gas is connected to the other end face. Further, although not shown, there may be provided an electric heater for conducting regeneration treatment, a temperature sensor, another piping for allowing combustion air to flow in, and the like.

According to excellent heat insulation properties of the holding material for a catalytic converter of the invention, the catalytic converter is hard to be influenced by outside air temperature even in a cold region to decrease the influence of changes in temperature in running, and the catalyst carrier 12 can be stably kept at high temperature. Further, also at the times of engine starting and idling, the temperature of the catalyst carrier 12 can be elevated to a desired temperature for a shorter period of time. Namely, attachment of the holding material for a catalytic converter of the invention causes the catalytic converter to show excellent gas purifying performance at the times of engine starting, idling and running. Further, according to excellent heat insulation properties of the holding material for a catalytic converter of the invention, heat transmitted to the metal casing can be decreased, and a heat insulation material such as a glass mat wound around the metal casing as needed becomes unnecessary. It is therefore expected that cost reduction become possible.

Further, also in regeneration treatment, the thermal efficiency is good, the regeneration time is shortened, and the regeneration rate is improved, which makes it possible to prolong the time until pressure drop and the like increase (the time until regeneration becomes necessary). Namely, the amount of particulates collected after regeneration increases.

When the catalytic converter is equipped with an electric heater for burning the particulates, the temperature of exhaust gas entering the catalyst carrier 12 can be efficiently increased for a short period of time, and the temperature of the exhaust gas can be sufficiently heightened. It is therefore possible to conduct the regeneration treatment for a short period of time.

Further, when the catalytic converter is equipped with no electric heater, a regeneration operation of a system of heighten the temperature of exhaust gas can be conducted. In this case, the exhaust gas passing through the catalyst carrier 12 can be sufficiently heightened because of excellent heat retaining properties of the catalyst carrier 12, and the particulates are burnt by the high-temperature exhausted gas to be able to perform regeneration.

Furthermore, a catalyst layer for removing noxious gas such as NOx or SOx may be additionally provided in the catalytic converter to remove both the noxious gas and the particulates. At the time of regeneration, the exhaust gas can be used as a supporting gas. Further, when the regeneration treatment is conducted using a pump, the catalytic converter can be so constituted as to pump air into a filter using the above-mentioned pump to conduct the regeneration treatment.

EXAMPLES

The invention will be described in more detail with reference to the following examples and a comparative example. However, the invention is not limited to these examples at all.

Example 1

A slurry containing 10 parts by mass of an acrylic resin as an organic binder and 10,000 parts by mass of water, based on 100 parts by mass of alumina fibers (alumina: 80% by mass, silica: 20% by mass) was obtained. This slurry was poured into a tabular mold, followed by dehydration molding to obtain a wet mat. This wet mat was dried at 100° C. while compressing it using a press plate to obtain a compressed mat having a basis weight of 1,100 g/m$^2$ and an organic content of 10%. The bulk density of the compressed mat was 0.17 g/cm$^3$, and the thickness was 8.5 mm. A fumed silica powder having an average primary particle size of about 7 nm was kneaded in a silica cloth having a weight of 500 g/cm$^2$, followed by compression to prepare a sheet acting as a low thermal conductivity layer. Here, the thermal conductivity at 300° C. of the sheet was 0.03 W/m·K, the thermal conductivity at 600° C. was 0.04 W/m·K, the bulk density was 0.84 g/m$^3$, and the thickness was 0.6 mm. Then, the mat and the sheet were adhered to each other with an ethylene-vinyl acetate adhesive to obtain a laminated body having a thickness of 9.1 mm. From this laminated body, stamping out into a predetermined shape was performed to obtain a holding material 13 comprising a mat layer 110 and a low thermal conductivity layer 100 as shown in FIG. 1.

The holding material 13 was wound around an outer peripheral portion of a catalyst carrier 12 comprising cordierite ceramic, which having a diameter of 110 mm and a length of 100 mm, with the low thermal conductivity layer disposed outside, and inserted in a SUS case having an inner diameter of 114 mm to prepare a catalytic converter. Further, a thermocouple was inserted from an interface between the catalyst carrier and the holding material to a center position in an axial direction of the catalyst carrier. This catalytic converter was attached to a heating vibration tester, hot air of 600° C. was allowed to flow at 5 m$^3$/minute while vibrating it, and the temperature at the above-mentioned position was measured. As a result, it was confirmed that the temperature reached 350° C. or more in 3 minutes after the hot air started to be allowed to flow. The room temperature before the hot air was allowed to flow was 20° C. Further, no problem occurred such as dropping off of the catalyst carrier.

Example 2

A holding material shown in FIG. 1 was obtained in the same manner as in Example 1 with the exception that "Pyrogel-6650" manufactured by Aspen Aerogels, Inc. was used as the low thermal conductivity layer. Here, the thermal conductivity at 300° C. of the low thermal conductivity layer was 0.02 W/m·K, the thermal conductivity at 600° C. was 0.03 W/m·K, the bulk density was 0.12 g/cm$^3$, and the thickness was 1 mm. The thickness of the resulting holding material was 9.5 mm.

Then, a catalytic converter was prepared by using this holding material in the same manner as in Example 1, and attached to a heating vibration tester to perform similar temperature measurement as in Example 1. As a result, it was confirmed that the temperature reached 350° C. or more after 2.5 minutes. Further, no problem occurred such as dropping off of the catalyst carrier.

Example 3

A mat comprising a blanket obtained by collecting alumina fibers (alumina: 80% by mass, silica: 20% by mass) in tabular form and needling the collected fibers was prepared. Here, the bulk density of the mat was 0.15 g/cm$^3$, and the thickness was 4.0 mm. Further, 80% by mass of a fumed silica powder having an average primary particle size of about 7 nm, 18% by mass of a silicon carbide having an average particle size of 3 μm as a radiant material, and 2% by mass of glass fibers having an average fiber diameter of 10 μm and an average fiber length of 5 mm as reinforcing fibers were mixed by a rotary mixing apparatus. Then, the resulting mixture was compression molded by a dry system to prepare a fumed silica-containing sheet used as a low thermal conductivity layer. Here, the thermal conductivity at 300° C. of the sheet was 0.025 W/m·K, the thermal conductivity at 600° C. was 0.03 W/m·K, the bulk density was 0.20 g/cm$^3$, and the thickness was 1.5 mm. Then, the sheet was held between the mats, and adhered to the mats with an ethylene-vinyl acetate adhesive to obtain a laminated body having a thickness of 9.5 mm. A laminated body having a desired shape was stamped out from this laminated body to obtain a holding material 13 in which a low thermal conductivity layer 100 was held between mat layers 110 as shown in FIG. 8.

Then, a catalytic converter was prepared by using this holding material in the same manner as in Example 1, and attached to a heating vibration tester to perform similar temperature measurement as Example 1. As a result, it was confirmed that the temperature reached 350° C. or more after 2.5 minutes. Further, no problem occurred such as dropping off of the catalyst carrier.

Example 4

A slurry containing 10 parts by mass of an acrylic resin as an organic binder and 10,000 parts by mass of water, based on 100 parts by mass of alumina fibers (alumina: 80% by mass, silica: 20% by mass) was obtained. This slurry was poured into a mold having a desired shape, followed by dehydration molding to obtain an wet mat on a surface of which a concave portion was formed. This wet mat was dried at 100° C. while compressing it using a press plate having a desired shape to obtain a compressed mat having a basis weight of 1,100 g/m$^2$ and an organic content of 10%. The bulk density of the compressed mat was 0.16 g/cm$^3$, the thickness was 8.5 mm, and the depth of the concave portion was 1 mm. Further, a fumed silica powder-containing sheet having the same shape and size as with the above-mentioned concave portion was prepared in the same manner as in Example 3. Here, the thermal conductivity at 300° C. of the sheet was 0.02 W/m·K, the thermal conductivity at 600° C. was 0.03 W/m·K, the bulk density was 0.12 g/m$^3$, and the thickness was 1 mm. Then, the sheet as the low thermal conductivity layer was fitted in the concave portion of the compressed mat, and adhered thereto with an ethylene-vinyl acetate adhesive to obtain a laminated body 13 as shown in FIG. 4. Further, a polyethylene nonwoven fabric having a thickness of 20 μm was laminated as a protective layer on the laminated body, and adhered thereto with an ethylene-vinyl acetate adhesive to obtain a holding material 13 as shown in FIG. 7.

Then, a catalytic converter was prepared by using this holding material in the same manner as in Example 1, and attached to a heating vibration tester to perform similar temperature measurement as in Example 1. As a result, it was confirmed that the temperature reached 350° C. or more after 3 minutes. Further, no problem occurred such as dropping off of the catalyst carrier.

Example 5

As described later, a surface of the mat obtained in Example 1 was impregnated with a silica aerogel precursor, and a laminated body having the silica aerogel precursor-impregnated layer impregnated with the silica aerogel precursor and a mat layer impregnated with no silica aerogel precursor was dried in a supercritical region to prepare a holding material having the mat layer and a composite material of the mat layer with an aerogel.

First, tetraethoxysilane was hydrolyzed, and then, stabilized at a low pH to obtain polydiethoxysiloxane (a silica precursor). Then, the silica precursor was mixed with ethanol to obtain a silica precursor solution. Thereafter, the silica precursor solution was poured into a vessel containing the mat, and a surface of the mat was impregnated with the silica precursor solution. To this silica precursor solution, 2% by volume of hydrofluoric acid based on the whole solution was added while stirring the silica precursor solution, thereby performing gelation. The gelled mat was placed in an ethanol bath of 50° C. and aged overnight in a hermetically sealed state. Then, subcritical and supercritical carbon dioxide gas extraction treatment was conducted to remove the alcohol from the gel over 4 days, thereby obtaining a holding material comprising a composite material of a silica gel with a porous substrate. Here, the bulk density of the mat layer was 0.15 g/cm$^3$, and the thickness was 6 mm. The thermal conductivity at 300° C. of the low thermal conductivity layer was 0.02 W/m·K, the thermal conductivity at 600° C. was 0.03 W/m·K, the bulk density was 0.13 g/m$^3$, and the thickness was 2 mm. Further, the thickness of the holding material was 8 mm.

Then, a catalytic converter was prepared by using this holding material in the same manner as in Example 1, and attached to a heating vibration tester to perform similar temperature measurement as in Example 1. As a result, it was confirmed that the temperature reached 350° C. or more after 2 minutes. Further, no problem occurred such as dropping off of the catalyst carrier.

Comparative Example 1

A mat comprising a blanket obtained by collecting alumina fibers (alumina: 80% by mass, silica: 20% by mass) in tabular form and needling the collected fiber was prepared. This mat was stamped out into a desired shape to obtain a holding material. Here, the thermal conductivity of the mat at 800° C. and at a density of 0.3 g/cm$^3$ was 0.12 W/m·K, the bulk density was 0.14 g/cm$^3$, and the thickness was 9.5 mm.

Then, a catalytic converter was prepared by using this holding material in the same manner as in Example 1, and attached to a heating vibration tester to perform similar temperature measurement in Example 1. As a result, it was confirmed that the temperature reached 350° C. or more after 6 minutes. Further, no problem occurred such as dropping off of the catalyst carrier.

Example 6

A holding material comprising only the composite material of the mat layer with the silica aerogel in the same manner as in Example 5 with the exception that the whole mat was impregnated with the silica aerogel precursor. Here, the thermal conductivity at 300° C. of the holding material comprising only the low thermal conductivity layer was 0.02 W/m·K, the thermal conductivity at 600° C. was 0.04 W/m·K, the bulk density was 0.13 g/m$^3$, and the thickness was 8.5 mm.

This holding material 13 was wound around an outer peripheral portion of a catalyst carrier 12 comprising cordierite ceramic, which having a diameter of 110 mm and a length of 100 mm, and inserted in a SUS case having an inner diameter of 114 mm to prepare a catalytic converter. This catalytic converter was attached to a heating vibration tester, hot air of 300° C. was allowed to flow while vibrating, and similar temperature measurement was performed. As a result, it was confirmed that the temperature reached 250° C. or more in 1 minute after the hot air started to be allowed to flow. The room temperature before the hot air was allowed to flow was 20° C. Further, no problem occurred such as dropping off of the catalyst carrier.

Further, using the holding material of Comparative Example 1, a catalytic converter was prepared in the same manner as in Example 6, and attached to a heating vibration tester to perform similar temperature measurement. As a result, it was confirmed that the temperature reached 250° C. or more after 3 minutes. Further, no problem occurred such as dropping off of the catalyst carrier.

While the present invention has been described in detail and with reference to specific embodiments thereof, it will be apparent to one skilled in the art that various changes and modifications can be made therein without departing from the scope thereof.

This application is based on Japanese patent application No. 2007-189192 filed Jul. 20, 2007, the entire contents thereof being hereby incorporated by reference. Further, all references cited herein are incorporated in their entireties.

What is claimed is:

1. A catalytic converter comprising a catalyst carrier, a metal casing for receiving the catalyst carrier, and a holding material wound around the catalyst carrier and interposed in a gap between the catalyst carrier and the metal casing, wherein the holding material comprises a low thermal conductivity layer, wherein the low thermal conductivity layer has a thermal conductivity at 300° C. of 0.04 W/m·K or less and comprises: a molded material containing an inorganic powder; or a composite material of a porous substrate with an aerogel, and a mat layer comprising inorganic fibers and laminated on the low thermal conductivity layer.

2. The catalytic converter according to claim 1, further comprising a protective layer.

3. The catalytic converter of claim 1, wherein a thickness of the low thermal conductivity layer is from 3 to 50% relative to the total thickness of the mat layer.

4. The catalytic converter of claim 1, wherein the low thermal conductivity layer is provided backing away from an end face on a suction side of the catalytic converter of the mat layer.

5. The catalytic converter of claim 1, wherein the low thermal conductivity layer is held between the mat layers or surrounded by the mat layer.

* * * * *